US006322443B1

(12) United States Patent
Jackson

(10) Patent No.: US 6,322,443 B1
(45) Date of Patent: Nov. 27, 2001

(54) DUCT SUPPORTED BOOSTER FAN

(76) Inventor: Ronald E. Jackson, 100 E. Thompson Rd., Indianapolis, IN (US) 46227

( * ) Notice: Subject to any disclaimer, the term of this patent is extended or adjusted under 35 U.S.C. 154(b) by 0 days.

(21) Appl. No.: 09/679,080

(22) Filed: Oct. 4, 2000

(51) Int. Cl.[7] ..... F24F 7/06

(52) U.S. Cl. ..... 454/329; 454/258; 417/423.15; 417/32; 415/213.1; 415/214.1; 416/246

(58) Field of Search ..... 454/329, 256, 454/258; 417/361, 423.15, 32, 44.11, 45, 360; 415/126, 127, 213.1, 214.1; 416/244 R, 246; 248/342, 343

(56) References Cited

U.S. PATENT DOCUMENTS

| | | | | |
|---|---|---|---|---|
| 4,576,331 | | 3/1986 | Harwell . | |
| 4,722,266 | | 2/1988 | Deckert . | |
| 4,754,697 | | 7/1988 | Asselbergs . | |
| 4,809,593 | | 3/1989 | Asselbergs . | |
| 4,846,399 | | 7/1989 | Asselbergs . | |
| 5,364,026 | * | 11/1994 | Kundert | 417/32 |
| 5,489,238 | | 2/1996 | Asselbergs . | |
| 5,492,456 | * | 2/1996 | Knight et al. | 417/360 |
| 5,607,354 | * | 3/1997 | Mill et al. | 454/189 |
| 5,632,677 | | 5/1997 | Elkins . | |
| 5,860,858 | | 1/1999 | Wettergren . | |
| 5,910,045 | | 6/1999 | Aoki et al. . | |

* cited by examiner

*Primary Examiner*—Jiping Lu
(74) *Attorney, Agent, or Firm*—Brinks Hofer Gilson & Lione

(57) ABSTRACT

A booster fan assembly includes a fan, an electric motor coupled to the fan, an electric cord coupled to the motor and adapted to be coupled to a source of electric power through a pair of thermostats and voltage reducing transformer, and a support coupled to the motor and adapted to be inserted in a heating/air conditioning duct from a distal end. The support has a flexible perimeter portion for contacting the interior surface of the duct and a central portion extending inward from the perimeter portion that is coupled to the motor. An outer surface of the support is selectively engageable with an interior surface of the duct at any selected location. The support is an incomplete ring that is collapsible from a first diameter to a second smaller diameter to permit insertion of the assembly into the duct. The support includes two inwardly directed handle portions normally spaced from each other, the handle portions being compressible toward each other to cause contraction of the perimeter portion. The support includes an outer surface formed of a conformable material for gripping the interior surface of the duct. The assembly is intended to be installed in a duct behind a register so that it is substantially invisible.

17 Claims, 2 Drawing Sheets

DUCT SUPPORTED BOOSTER FAN

BACKGROUND OF THE INVENTION

The present invention is directed to electromechanical apparatus for improving air flow through a duct system such as is commonly present in a home heating and air conditioning system.

Most homes that have forced air heating and air conditioning systems include only a single heating unit or furnace that commonly includes a plenum containing a heat exchanger and a refrigeration coil connected to an air conditioning unit. A single fan, operating in response to a single centrally placed thermostat, forces air to flow through a duct system that includes the furnace plenum. The duct system distributes the thermally treated air to various rooms of the home that are typically located at varying distances from the furnace. The length of duct work between the furnace and any given room of the home typically varies considerably, which causes the cooling and heating to occur preferentially in certain portions of the home.

It is known that enhanced uniformity in cooling and heating of a home can be achieved by equipping the home with multiple forced air heating and air conditioning units each of which is controlled by a thermostat located within a particular zone of the home. While such zone controlled systems operate very satisfactorily, they are generally substantially more expensive and cannot be economically justified in many circumstances.

It is also known to enhance the distribution of air through one duct of a duct system with the aid of a booster fan located in the duct work, often near or at a register end of the duct. Typically such fans are wired in conjunction with the furnace fan so that they are controlled by the same thermostat, and turn on and off with the furnace fan. It is also known, for example from U.S. Pat. No. 5,860,858, to control the operation of such a duct fan based on sensed air pressure within the duct. It is also known, for example from U.S. Pat. Nos. 4,576,331 and 5,632,677 to simply supply the fan with power on a continuous basis, and to control the supply of power to the fan with a thermostat located in the vicinity of the register.

The mechanical installation of such booster fans has typically been accomplished by inserting a special segment of ducting containing the booster fan as shown, for example, in U.S. Pat. No. 5,860,858. Such an installation typically requires tools to cut an existing segment from the duct work followed by sealing the new special segment in place within the duct work, often in very uncomfortable circumstances, such as in a crawl space under a home. To avoid such complex installation, both U.S. Pat. Nos. 4,576,331 and 5,632,677 disclose the alternative of simply replacing the existing register with a special register containing the booster fan. Unfortunately the known embodiments of such special registers have an unsightly appearance and are therefore undesirable.

What is needed is a booster fan mechanism that is easily installed without any special tools, yet is substantially invisible once it is installed.

SUMMARY OF THE INVENTION

A booster fan of the present invention is designed for use in a forced air heating and air conditioning system, where the system includes a duct having distal end and a register situated at a distal end of the duct leading to a room to which an enhanced flow of thermally treated air is desired. The booster fan assembly includes a fan, an electric motor coupled to the fan, an electric cord coupled to the motor and adapted to be coupled to a source of electric power, and a support coupled to the motor and adapted to be inserted in the duct from the distal end. The support has a flexible perimeter portion for contacting the interior surface of the duct and a central portion extending inward from the perimeter portion that is coupled to the motor. An outer surface of the support is selectively engageable with an interior surface of said duct at a selected location near said distal end. The support can take the form of an incomplete ring that is collapsible from a first diameter to a second smaller diameter to permit insertion of the assembly into the duct from the distal end. The support can also include two inwardly directed handle portions normally spaced from each other, the handle portions being compressible toward each other to cause contraction of the perimeter portion. Preferably, the support includes an outer surface formed of a conformable material for elastically gripping the interior surface of the duct and inhibiting any fan noise.

The booster fan assembly of the present invention should preferably be selected to have a fan diameter that is at least 70% of the diameter of the duct in which the assembly is to be inserted. The assembly also should include at least one sensor connected to the electric cord and responsive to a condition of the air in the vicinity of the fan to control the flow of electric power from the source to the motor. The sensor preferably takes the form of a pair of sensors arranged in parallel to each other, a first of the pair of sensors being responsive to air below a first selected temperature to cause power to be conducted from the source to the motor in the presence of cooled air in the duct, and a second of the pair of sensors being responsive to air above a second selected temperature to cause power to be conducted from the source to the motor in the presence of heated air in the duct. To ensure safe operation of the booster fan, the assembly also preferably includes a transformer coupled to the plug end of the electric cord for transforming the conventional source voltage of 117 VAC to a safer lower voltage, of about 24 VAC, or less.

The booster fan assembly of the present invention is intended to be installed in the duct by removing the register from the distal end of the duct, and inserting the booster fan assembly into the duct while deflecting the flexible perimeter portion of the support toward the center of the duct. Once the assembly is positioned at the desired location in the duct, one allows the flexible perimeter portion to expand outwardly into contact with a inner surface of the duct. In using the illustrated embodiment of the present invention, the inward deflection and outward expansion of the support perimeter portion is controlled by grasping two inwardly directed handle portions connected to the flexible perimeter portion of the support, and moving the handle portions toward each other to cause contraction of the perimeter portion of the support while positioning the support at said selected position, the perimeter having sufficient spring-like memory to expand against the interior surface of the duct upon release of the handle portions. The electrical cord is then extended out from the distal end of the duct to a convenient electrical socket that can provide power to the booster fan assembly. The register is then replaced onto the distal end of the duct so that the booster fan assembly becomes substantially invisible.

This entire installation procedure can usually be achieved quickly and without the use of any tools or hardware. The support can be made in a variety of sizes to fit the variety of duct sizes conventionally employed in both home and commercial systems. The low voltage motor and wiring makes concealment of the installation easy and safe. The dual thermostat control ensures that the fan will automatically come on when there is warmed air or cooled air in the duct. These and other features and advantages of the present invention will become apparent from a consideration of the following description of the preferred embodiment that references the accompanying drawings.

DESCRIPTION OF THE PREFERRED EMBODIMENT

Figure 1:
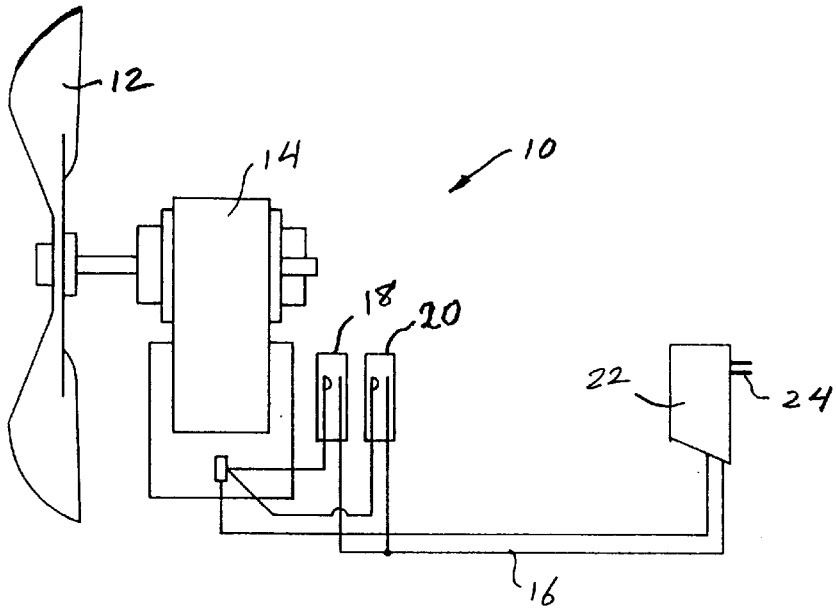
FIG. 1 is a pictorial illustration of the electrical elements of the present invention.
Figure 2:
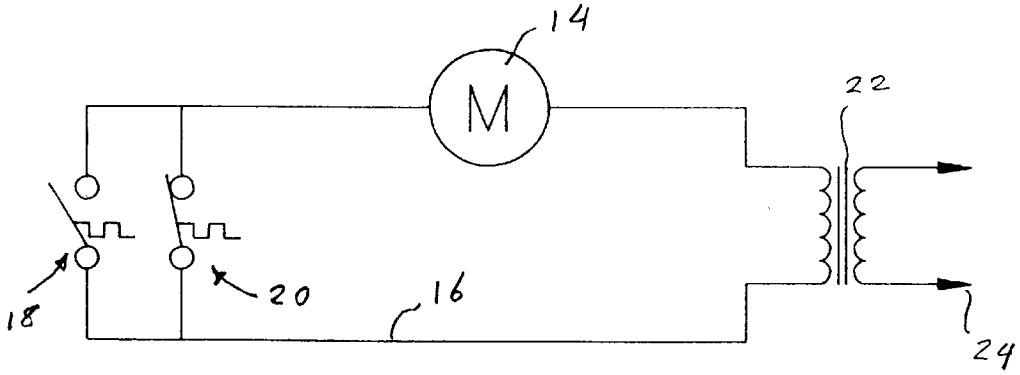
FIG. 2 is a schematic illustration of the electrical elements of the present invention.

FIGS. 1–4 show a booster fan assembly 10 of the present invention. The assembly 10 includes a fan 12 and an electric motor 14 coupled to the fan. An electric cord 16 is coupled to the motor 14 for supplying the motor with electric power through a pair of thermostats 18 and 20. A voltage reducing transformer 22 is provided at the plug end of the electric cord 16 and includes prongs 24 adapted to be inserted into a standard wall outlet of electric power. The electrical portion of the apparatus is schematically illustrated in FIG. 2.

The thermostats 18 and 20 are intended to be responsive to the presence of cooled air or heated air in the duct, respectively. The thermostats 18 and 20 are most simply constructed from bimetallic switches which have opposite thermal response characteristics. Desirably, both of the thermostats remain open through a range of temperature generally indicative of the fact that no heating or cooling is occurring. For example, both thermostats 18 and 20 might remain in a non-conductive state through the range of at least from 70° to 80° F. and more preferably over the range of 65° to 85° F. One of the thermostats is thermally responsive to the presence of cold air so that when air conditioned air is sensed by the thermostat in the duct, the switch closes to cause conduction of electrical power through line 16 to motor 14. The second thermostat is thermally responsive to the presence of heat so that when heated air is sensed in the duct, the thermostat will close allowing conduction of electric power through line 16 to motor 14. In the absence of either heated or cooled air in the duct in which the assembly is placed, both thermostats 18 and 20 remain in an open, non-conducting state thereby preventing electrical power from energizing motor 14.

Figure 3:
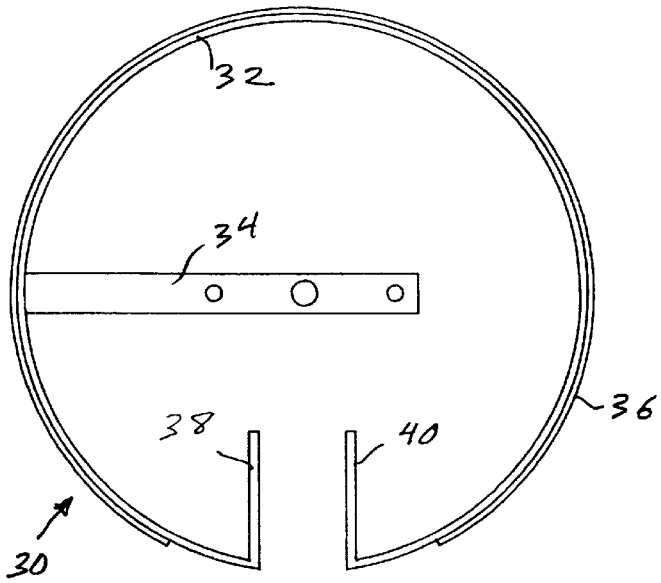
FIG. 3 is a front elevation view of a support suitable for use in the present invention.
Figure 4:
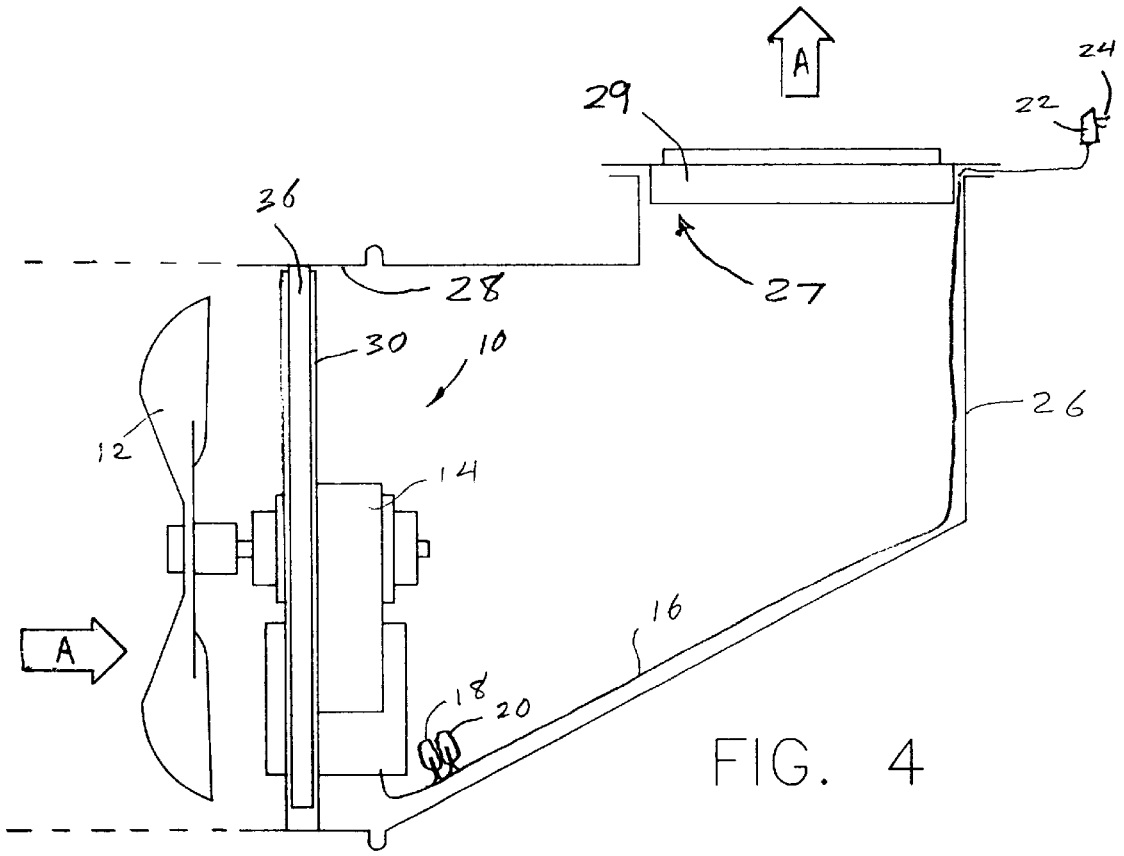
FIG. 4 is a side elevation view of the mechanical elements of the present invention installed in a duct below a register, the duct and register being shown schematically.

The electric motor 14 and fan 12 are supported by a support 30 shown in FIGS. 3 and 4. The support 30 has a flexible perimeter portion 32 for contacting the interior surface of a duct 28 in which the assembly 10 is placed. The support 30 also includes a central portion 34 that extends inward from the perimeter portion 32 that is coupled to motor 14 and supports the motor 14 and fan within the duct 28. An outer surface portion 36 of the support 30 engages the interior surface of the duct 28 and is formed of a conformable material that is capable of elastically gripping the interior surface of the duct and damps any vibration that may be caused by the rotation of the fan 12 by motor 14. The conformable material 36 can be formed of a rubber gasket or coating material applied to the outer surface of the perimeter portion 32. The support 30 also includes two inwardly directed handle portions 38 and 40 that are normally spaced apart from each other as shown in FIG. 3. The perimeter portion 32 is preferably formed of steel or other material having sufficient elasticity and memory to be elastically deformable from the shape shown in FIG. 3 by a pressure collapsing handles 38 and 40 toward each other. The collapse achieved by the displacement of the handles 38 and 40 toward each other causes the perimeter portion 32 to change from a first larger diameter to a smaller second diameter which facilitates installation of the assembly into the duct 28.

As shown in FIG. 4, the duct 28 terminates in a boot portion 26 having an upwardly directed opening 27 capped by a register 29. Air flow in the direction A from an air heating/cooling system will flow through the spaces provided in the fan assembly 10 and out through the register 29 into the room or other area sought to be thermally modified by the forced air inflow.

The booster fan assembly 10 of the present invention can be easily installed in the duct 28 by removing the register 29 from the distal end 17 of the duct. The booster fan assembly 10 is then inserted into the duct while deflecting the flexible perimeter portion 32 away from the edges of the duct 28. Once the assembly is positioned at a desired location to end the duct, one then allows the flexible perimeter portion 32 to expand outwardly to contact the inner surface of the duct. The inward deflection and outward expansion of the support perimeter 32 is achieved by manually collapsing the handles 38 and 40 toward each other and then later releasing one's grip on the handles thereby allowing them to spread apart under influence of the resilient character above the perimeter portion.

The electrical cord 16 is then extended out from the distal end 27 of the duct to a convenient electrical socket that can provide power to the booster fan assembly. The register 29 is then replaced onto the distal end 27 of the duct so that the booster fan assembly 10 becomes substantially invisible from the room served by the duct 28. This entire installation can usually be achieved without the use of any tools or hardware whatsoever. The portion of the electrical cord 16 leading from the register 29 to a suitable wall outlet can easily be hidden by carpeting or other covering materials. The use of a low voltage transformer 22 and motor 14 allow the wiring forming the electrical cable 16 to be sufficiently small to be easily concealed or at least to make minimal intrusion.

While the present invention has been described with reference to the illustrated embodiment shown in the accompanying figures, it will be appreciated by those skilled in the art that non-illustrated variations encompassed by the statement of the invention as previously summarized and as claimed in the following claims.

What is claimed is:

1. A booster fan assembly suitable for use in a forced air heating and air conditioning system, the system including a duct having distal end including a boot and a register situated on the boot at a distal end of the duct, the assembly comprising:

a fan, an electric motor coupled to the fan, an electric cord coupled to the motor and adapted to be coupled to a source of electric power, and a support coupled to the motor and adapted to be inserted in said duct through the boot from said distal end, the support having an outer surface selectively engageable with an interior surface of said duct near the boot at said distal end.

2. The booster fan assembly of claim 1 wherein the support comprises an incomplete ring collapsible from a first diameter to a second smaller diameter to permit insertion of the assembly into the duct from the distal end.

3. The booster fan assembly of claim 1 wherein the support includes an outer surface formed of a conformable material for gripping the interior surface of the duct.

4. The booster fan assembly of claim 1 wherein the support comprises a flexible perimeter portion for contacting the interior surface of the duct and a central portion extending inward from the perimeter portion and coupled to the motor.

5. The booster fan assembly of claim 1 wherein the support comprises a perimeter portion and two inwardly directed handle portions normally spaced from each other, the handle portions being compressible toward each other to cause contraction of the perimeter portion.

6. The booster fan assembly of claim 1 wherein the support comprises a generally circular ring portion having a diameter approximately the same as the duct, and wherein the fan diameter is at least 70% of the diameter of the ring portion of the support.

7. The booster fan assembly of any of claims 1–6 further comprising at least one sensor connected to the electric cord and responsive to a condition of the air in the vicinity of the fan to control the flow of electric power from the source to the motor.

8. The booster fan assembly of claim 7 wherein the at least one sensor comprises a pair of sensors arranged in parallel to each other, a first of the pair of sensors responsive to air below a first selected temperature to cause power to be conducted from the source to the motor and a second of the pair of sensors responsive to air above a second selected temperature to cause power to be conducted from the source to the motor.

9. The booster fan assembly of claim 7 further comprising a transformer coupled to the electric cord for transforming the source voltage to a safer lower voltage.

10. A booster fan assembly suitable for use in a forced air heating and air conditioning system, the system including a duct having distal end and a register situated at a distal end of the duct, the assembly comprising:

a fan, an electric motor coupled to the fan, an electric cord coupled to the motor and adapted to be coupled to a source of electric power, and a support coupled to the motor, the support comprising a flexible perimeter portion including an outer surface for contacting the interior surface of the duct, a central portion extending inward from the perimeter portion and coupled to the motor, and two inwardly directed handle portions normally spaced from each other, the handle portions being movable relative to each other to cause contraction of the perimeter portion of the support to permit insertion of the assembly into the duct from the distal end.

11. The booster fan assembly of claim 10 wherein the support comprises an incomplete ring collapsible from a first diameter to a second smaller diameter by moving the handle portions toward each other to permit insertion of the assembly into the duct from the distal end.

12. The booster fan assembly of claim 10 wherein the support includes an outer surface formed of a conformable material for gripping the interior surface of the duct.

13. The booster fan assembly of any of claims 10–12 further comprising a pair of sensors arranged in parallel to each other and coupled to the electric cord adjacent to the motor, a first of the pair of sensors being responsive to air below a first selected temperature to cause power to be conducted from the source to the motor and a second of the pair of sensors being responsive to air above a second selected temperature to cause power to be conducted from the source to the motor, the first and second temperatures being spaced from each other so that for some range of temperature between the first and second temperatures no power is conducted through either of the pair of sensors.

14. The booster fan assembly of claim 13 further comprising a transformer coupled to the electric cord for transforming the source voltage to a safer lower voltage.

15. A method for installing a booster fan assembly into a forced air heating and air conditioning system, the system including a duct having distal end and a register situated at a distal end of the duct, the method comprising the steps of:

providing a booster fan assembly comprising a fan, an electric motor coupled to the fan, an electric cord coupled to the motor and adapted to be coupled to a source of electric power, and a support including a flexible perimeter portion for contacting the interior surface of the duct and a central portion extending inward from the perimeter portion and coupled to the motor;

removing the register from the distal end of the duct;

deflecting the flexible perimeter portion of the support toward the center of the duct while inserting the booster fan assembly into the duct;

allowing the flexible perimeter portion to expand outwardly into contact with a inner surface of the duct at a selected position adjacent to the distal end of the duct; and replacing the register onto the distal end of the duct so that the booster fan assembly becomes substantially invisible.

16. The method of claim 15 further comprising the steps of passing an end portion of the electric cord out through the distal end of the duct; and connecting the end portion of the electric cord to a source of electric power.

17. The method of claim 15 wherein the deflecting step comprises the steps of grasping two inwardly directed handle portions connected to the flexible perimeter portion of the support, and moving the handle portions toward each other to cause contraction of the perimeter portion of the support while positioning the support at said selected position.

* * * * *